United States Patent [19]

Masumoto

[11] Patent Number: 4,800,810

[45] Date of Patent: Jan. 31, 1989

[54] IMPACT RICE HULLER

[75] Inventor: Toyojiro Masumoto, Hoya, Japan

[73] Assignee: Yamamoto & Co. Ltd., Tendou, Japan

[21] Appl. No.: 74,308

[22] Filed: Jul. 15, 1987

[30] Foreign Application Priority Data

Jul. 24, 1986 [JP] Japan ..... 61-174300
Aug. 1, 1986 [JP] Japan ..... 61-181782

[51] Int. Cl.[4] ..... B02B 3/00; B02B 7/02

[52] U.S. Cl. ..... 99/519; 99/524; 99/601; 99/620

[58] Field of Search ..... 99/519, 524, 525, 600–604, 99/609–611, 621, 622, 620; 426/481, 482

[56] References Cited

U.S. PATENT DOCUMENTS

| | | | |
|---|---|---|---|
| 1,051,877 | 2/1913 | Gabbett-Fairfax | 99/601 |
| 2,529,679 | 11/1950 | Dodds | 99/519 X |
| 3,098,515 | 7/1963 | Forsberg | 99/519 |
| 3,561,515 | 2/1971 | Nahm | 99/519 |
| 4,196,224 | 4/1980 | Falk | 99/622 X |
| 4,341,152 | 7/1982 | Solenthaler | 99/609 |
| 4,393,762 | 7/1983 | Jacobs | 99/612 X |
| 4,459,903 | 7/1984 | Yamamoto | 99/611 X |
| 4,628,807 | 12/1986 | Dopp | 99/516 X |

*Primary Examiner*—Timothy F. Simone
*Attorney, Agent, or Firm*—Browdy and Neimark

[57] ABSTRACT

A vertical type impact rice huller which is free from the occurrence of collision of the grain is disclosed. The apparatus comprising a vertical rotary shaft; an unbrella type feeder rigidly mounted on an upper portion of the shaft and adapted to turn with the shaft, said feeder having an upper cover and a bottom plate approximately parallel to the upper cover, the upper cover having array channels on an outer portion of its under surface, and said feeder further having an annular ejection port formed between outer ends of the cover and the bottom plate for shooting the grain therefrom; an annular support member surrounding the ejection port in the peripherably spaced relationship thereto and having an recess in which an elastic member is detachably mounted, and said support member adapted to be moved in the vertical direction; an air separating chamber provided below the feeder for separating the husk from the processed grain; means for reducing a falling speed of the processed grain is provided between the ejection port and the air separating chamber.

5 Claims, 7 Drawing Sheets

IMPACT RICE HULLER

BACKGROUND OF THE INVENTION

1. Field of Utilization of the Invention

This invention relates to a vertical type impact rice huller.

2. The Prior Art

Prior to the present invention, the use of the impact rice huller was known. In the impact rice huller, the grain, such as the rice, is radially shot at a very high speed from an ejection of a feeder and strikes an annular elastic plate surrounding the ejection, then the grain is hulled by the impact force.

Problems to be Solved by the Invention

In a series of the hulling action of this type, 85% of the supplied grain is hulled, and not 100% at once. remaining 15% of the grain is left unhulled and returned to a supply hopper of the feeder by a lift.

The reason why the 100%-hulling is not to be done is that some of the grain which is radially shot at a very high speed toward an elastic plate by the feeder collides with the grain already reflected by the plate on its way.

Summary of the Invention

Therefore, one of the objects of the present invention is to provide an impact rice huller which is free from the occurrence of collision of the grain and enables the 100% hulling to be done.

Brief Description of the Invention

Other objects of the invention will appear in the course of the description thereof, described by way of example with reference to the drawings, in which FIG. 1 is a perspective view showing the outer appearance of an embodiment as a whole;

DETAILED DESCRIPTION OF THE PREFERRED EMBODIMENT

Figure 1:
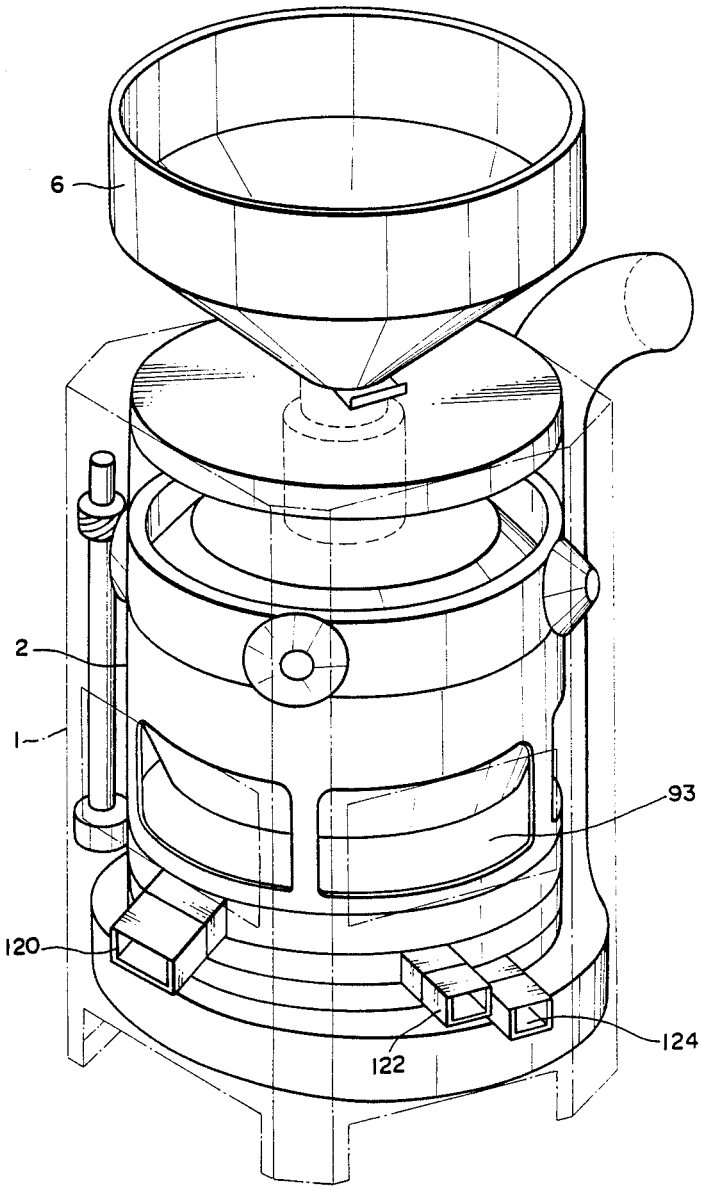
Figure 2:
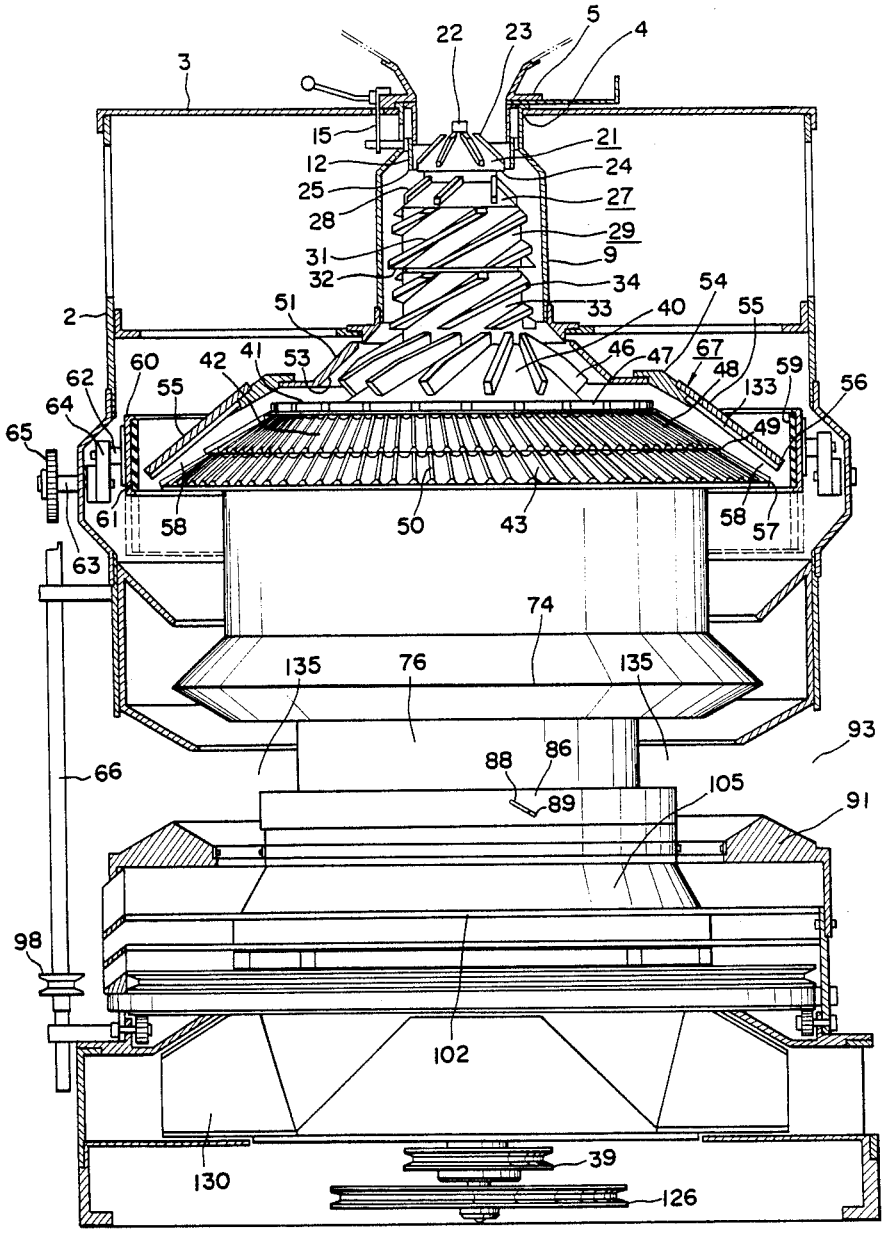
FIG. 2 is a partially cutaway view in side elevation of the embodiment.
Figure 3:
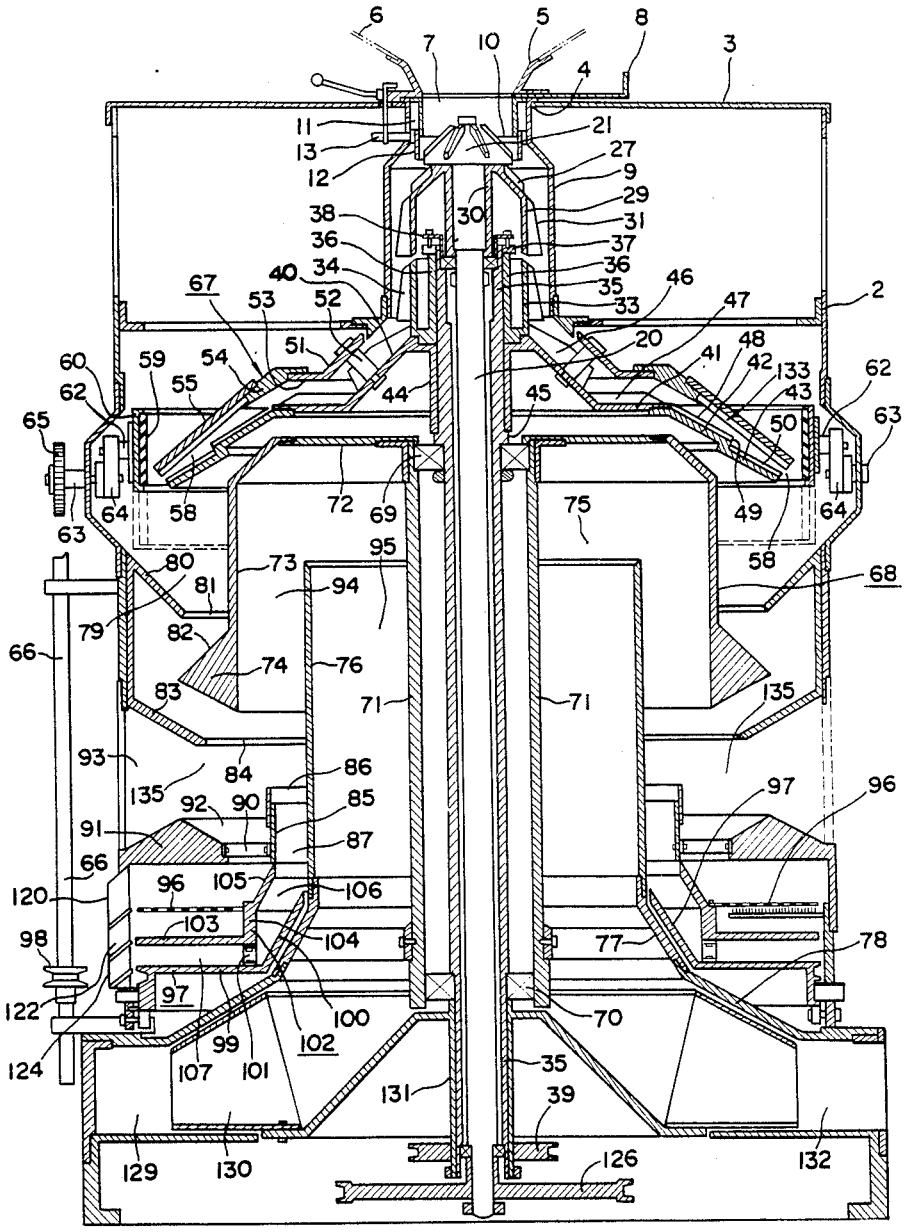
FIG. 3 is a longitudinal sectioned side elevation of the embodiment.
Figure 4:
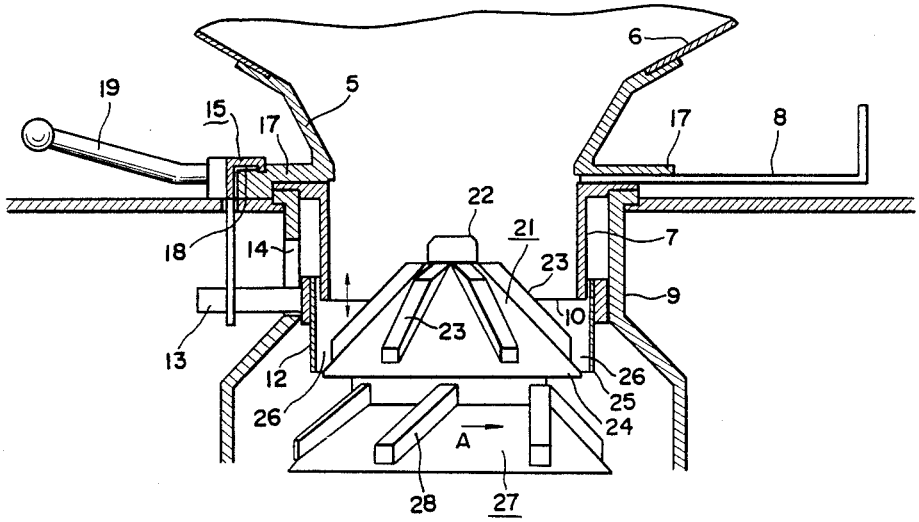
FIG. 4 is an enlarged section of a feed section.
Figure 5:
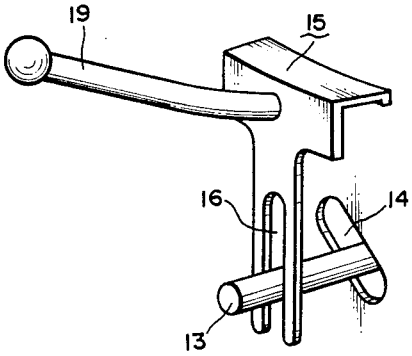
FIG. 5 is a perspective view of an operating section.

Referring now in detail to the drawings, reference numeral 1 denotes an outer case enclosing an effective part as a whole of a rice huller and consisting of a thin iron plate. An inner cylindrical case 2 is provided in the outer case 1. Reference numeral 3 denotes an upper wall of the inner case 2, which upper wall 3 is formed in the shape of a horizontal disc having a vertical opening 4 in the central portion thereof and a hopper-setting member 5 placed on and fixed to the upper portion of the opening 4. Reference numeral 6 denotes a hopper for unhulled rice, which is detachably mounted on the upper portion of the member 5. An inner vertical cylinder 7 is fixed to the bottom surface of the hopper-setting member 5. Reference numeral 8 denotes a shutter for the hopper 6, and 9 an outer vertical cylinder surrounding the outer surface of the inner cylinder 7. The lower end of outer cylinder 9 is considerably lower than a lower end 10 of the inner cylinder 7.

An annular vertical gap 11 is formed between the inner vertical cylinder 7 and an upper end portion of the outer cylinder 9. An annular regulating cylinder 12 is vertically and slidably fitted in the gap 11. When the regulating cylinder 12 is in the lowest position, the upper end thereof is not lower than the lower end 10 of the inner cylinder 7.

A horizontal rod 13 which is fixed at its inner end to a desired part of the upper portion of the regulating cylinder 12 extends through and projects outwardly from a diagonal slot 14 formed in the outer cylinder 9. The lower end section of a vertical bifurcated portion 16 of an operating member 15 is engaged with the free end portion of the horizontal rod 13. The operating member 15 is engaged with a toothed locking portion 18 which is formed on the upper surface of an annular flange 17 of the hopper-setting member 5. The operating member 15 moves arcuately and intermittently by such a distance at once that corresponds to the width of one tooth of the toothed locking portion 18. Reference numeral 19 denotes an operating lever for the operating member 15. When the operating member 15 is arcuately moved in the horizontal direction, the horizontal rod 13 is moved by the bifurcated portion 16 to cause the regulating cylinder 12 to move vertically due to the diagonal slot 14.

A vertically elongated rotary shaft 20 is provided in the central portion of the outer cylinder 9. A first distributor 21 having a conical shape and usually consisting of an integral casting is mounted on the upper end portion of the rotary shaft 20 and fixed by a bolt 22 from the upper side thereof. A plurality of radially-extending first distribution ribs 23 are formed on the outer surface of the first distributor 21 by subjecting the first distributor 21 to an expansion step. There are preferably six of the first distribution ribs 23 is preferably six.

The lower end 24 of the first distributor 21 is positioned in the vicinity of the lower end 25 of the vertical regulating cylinder 12, and a port 26 for regulating the falling rate of unhulled rice is formed between these lower ends 24, 25. The purpose of providing the first distribution ribs 23 is to hit the unhulled rice against the inner surface of the regulating cylinder 12 so that the rice scatters uniformly with each grain not colliding with another, and thereby cause the rice to fall from the regulating port 26 with each grain not colliding with another.

A second distributor 27 is provided under the first distributor 21. The second distributor 27 is also provided on its outer surface with second distribution ribs 28, the number of which is equal to that of the distribution ribs 23. The second distributor 27 is conically formed so that the outer surface thereof is inclined a little more gently than that of the first distributor 21. The upper portion of the outer cylinder 9 is opposed to the second distributor 27 with an annular gap left therebetween. The second distribution ribs 28 are under the falling rate-regulating port 26, and the outer end portion of the second distributor 27 is positioned a little more outside of the port 26.

The second ribs 28 are provided so that they have an angle of sweepback with respect to the rotational direction A. Accordingly, when the unhulled rice impinges upon the second ribs 28, it flows as it scatters slidingly, to hit on the inner surface of the outer cylinder 9, and the resultant unhulled rice is distributed uniformly. Since the numbers of the first and second ribs 23, 28 are equal, the unhulled rice guided by the first ribs 23 continues to flow smoothly along the passages among the second ribs 28.

A first feed member 29 is provided under the second distributor 27. The second distributor 27 and first feed member 29 usually consist of an integral casting, on the inner side of which an inner vertical sleeve 30 is formed integrally therewith. The sleeve 30 is inserted from the upper side of and joined to the rotary shaft 20.

First twisted feed ribs 31 are formed on the outer surface of the first feed member 29. The first feed ribs 31 are inclined gently so as to feed the grain, which is turned together due to the rotation of the first and second distributors 21, 27, gradually in the downward direction. The height of each of the first feed ribs 31 is small at the upper portion thereof, increases gradually toward the lower portion thereof and becomes maximal at the lower end 32 thereof. The grain positioned in the lower end 32 turns at such a speed that is substantially equal to that of the lower end 32.

Because of this arrangement, the grain is sent excellently onto the second feed ribs 34 on a second feed member 33 which is provided under the first feed member 29. The first and second feed members 29, 33 are formed having a constant diameter and independently of each other.

A double rotary shaft 35 is provided around the rotary shaft 20 via bearings, its upper end faces the lower end portion of the inner vertical sleeve 30, and its lower end extends to the lower end of the main part of the rice huller. The second feed member 33 is fitted around the double shaft 35. The upper end of the inner cylinder 36 of the second feed member 33 is lower than the upper end of the double shaft 35. The outer surface of the double shaft 35 where the shaft projects beyond the upper end of the inner vertical cylinder 36 is threaded, and a nut 37 is engaged with the threaded portion to fix the second feed member 33 to the double shaft 35. Reference numeral 38 denotes a metal retainer for the nut 37.

A small-diameter pulley 39 is indirectly mounted on the lower end portion of the double shaft 35 so that the double shaft 35 is turned at a higher speed than the vertical rotary shaft 20. Consequently, the second feed ribs 34 are turned at a higher speed than the first feed ribs 31. A first acceleration member 40 is formed integrally with and at the lower end of the second feed member 33, a second acceleration member 41 integrally with and at the lower end of the first acceleration member 40, a third acceleration member 42 separately from and at the lower end of the second acceleration member 41, and a fourth acceleration member 43 integrally with and at the lower end of the third acceleration member 42.

The first acceleration member 40 is conical so that the diameter thereof increases gradually toward the lower end thereof. This first member 40 is provided therein with an inner vertical cylinder 44, which is fitted around the outer surface of the double shaft 35. The lower end of the inner cylinder 44 is supported on a flange 45 which is formed on the double shaft 35. The lower end of the inner cylinder 36 is joined to the upper end of the inner vertical cylinder 44.

The first acceleration member 40 is provided on the outer surface thereof with first acceleration ribs 46, the number of which is twice as many as that of the second feed ribs 34. The height of each of the first acceleration ribs 46 is small at the upper end thereof, increases gradually up to the intermediate portion to thereof, and is equal from the intermediate portion to the lower end thereof.

The second acceleration member 41 is provided on its upper surface with second acceleration ribs 47. The height of these ribs 47 is almost constant, and the number thereof is twice as many as that of the first acceleration ribs 46. Although the first acceleration ribs 46 are formed so as to have an angle of sweepback, the second acceleration ribs 47 are radially provided, and do not have an angle of sweepback.

The third and fourth acceleration members 42, 43 are formed separately from the second acceleration member 41 and fixed thereto at the upper end portion of the third acceleration member 42 by a desired fixing means. The third acceleration member 42 is conically formed, and the upper surface thereof is inclined more gently than that of the first acceleration member 40. The third acceleration member 42 is provided on its upper surface with third acceleration ribs 48, the number of which is three or four times as many as that of the second acceleration ribs 47. An annular stepped portion 49 is formed at the boundary portion between the third and fourth acceleration members 42, 43. The fourth acceleration ribs 43 is provided thereon with fourth acceleration ribs 50, the number of which is equal to that of the third acceleration ribs 48. A cover 51 is provided over and formed in an approximately parallel relationship with the upper side of the first and second acceleration members 40, 41. The cover 51 is joined to the acceleration members 40, 41 by connecting members 52.

Therefore, the cover 51 is rotated unitarily with the first and second acceleration members 40, 41, and enables the grain discharged from the first acceleration ribs 46 to be reflected by the under surface thereof and supplied to the second acceleration ribs 47. Reference numeral 53 denotes a surface serving as a reflector.

An umbrella type array member 55 is fixed unitarily to the terminal portion of the cover 51 via an annular connecting member 54. The array member 55 has array channels 133 on the under surface thereof. The clearance between these array channels 133 and the fourth acceleration member 43 decreases gradually toward the lower ends 56 thereof. A circumferential ejection port 58 is formed between the lower end 56 and the lower end 57 of the fourth acceleration member 43.

A vertical belt type elastic member 59 is provided around the ejection port 58. The elastic member 59 is formed in the shape of a belt and set elastically in vertically-extending state within the inner surface of an annular support member 60. More say more precisely, an annular recess 61 is formed in the inner surface of the support member 60 for fitting the elastic member 59 therein, and the vertical width of the support member 60 is longer than that of the elastic member 59. The elastic member 59 is elastically contracted and fitted in the recess 61 and then expanded elastically so as to be set therein.

The annular support member 60 is provided on its outer surface with horizontal shafts 62 which project therefrom radially, and which are spaced from one another at 120° or 90° . Horizontal rotary shafts 63 are provided in the vicinity of the horizontal shafts 62. Each outer end of rotary shafts 63 is rotatably mounted on the inner case 2 and inner ends are secured to the link members 64, respectively. The other ends of the link members 64 are loosely fitted around the horizontal shafts 62, respectively. When the link members 64 are turned 360° along a plane, the horizontal shafts 62 are slidingly moved with respect to the link members 64 and cause the annular support member 60 to move vertically and rotatably. Worm wheels 65 are mounted on the outer end portions of the rotary shafts 63. The worm wheels 65 are engaged with worms which are provided on the top of vertical rotary shafts 66.

A feeder 67 has an upper cover and a bottom plate; the upper cover consists of cover 51, annular connecting member 54 and umbrella type array member 55; the bottom plate consists of first to fourth acceleration members.

An inverted cup-shaped air passage cover 68 is provided below the feeder 67. A fixed vertical sleeve 71 is slightly lower than the lower end of the inner vertical cylinder 44, and fixed to the air passage cover 68. The air passage cover 68 has a horizontal right-circular upper wall 72 and an annular side wall 73. A triangular projection 74 is formed on the outer surface of the lower end portion of the side wall 73. A horizontal air passage 75 is formed within the air passage cover 68.

A vertical suction cylinder 76 is provided between the vertical cylinder 71 and side wall 73. The upper end of the suction cylinder 76 is positioned in the air passage 75, and the lower end thereof is joined to a fixed frame 78 via a connecting portion 77.

An upper inclined member 80 is provided around the annular side wall 73 and extends toward the lower end of the annular side wall 73. The inclined member 80 and the side wall 73 for a discharge chamber 79. A drop port 81 is formed at the lower end of the discharge chamber 79. The grain falling from the drop port 81 impinges upon an upper inclined surface 82 of the projection 74 and are outwardly guided, then the grain falls onto a lower inclined member 83. Thus the grain flows along such a bent or zigzag passage. Although the speed of the processed grain discharged from the ejection port 58 is considerably high, the bent passage reduces gradually it.

A separating cylinder 85 is provided around the lower portion of the suction cylinder 76. A regulating. cylinder 86 is slidably mounted on the upper portion of the separating cylinder 85. An annular gap 87 between the regulating cylinder 86 and the suction cylinder 76 serves as an inlet for unripened grain. Inclined slots 88 are formed in the regulating cylinder 86, and pins 89 projecting from the separating cylinder 85 are fitted in the inclined slots 88. When the regulating cylinder 86 is turned in the circumferential direction by a desired method, the regulating cylinder 86 moves in the vertical direction.

An annular member 91 is provided on the outer side of the separating cylinder 85 via horizontal connecting members 90. The annular member 91 has a mountain-shaped cross section, and the clearance between the separating cylinder 85 and annular member 91 constitutes a drop port 92 for the hulled rice and the waste or broken rice.

The annular member 91 is positioned below the lower inclined member 83, and an air inlet port 93 is formed between the lower member 83 and the annular member 91. An air separating chamber 135 is formed between a drop port 84 of the lower inclined member 83 and a drop port 92. Reference numeral 94 denotes an annular upward air flow passage formed between the suction cylinder 76 and the annular side wall 73, and 95 an annular downward air flow passage formed between the fixed vertical cylinder 71 and suction cylinder 76.

A perforated sorting plate 96 is provided below the drop port 92 and receives the broken and waste rice grains. Reference numeral 97 denotes a rotary member provided around the outer side of the connecting portion 77. The rotary member 97 has a horizontal portion 99 and an inclined portion 100, and is adapted to be turned by a pulley 98 mounted on the lower end portion of one of the vertical rotary shafts 66. The inner end of the horizontal portion 99 is close to the connecting portion 7, and the outer end thereof is close to the inner case 2. The upper end of the inclined portion 100 is close to the lower end of the suction cylinder 76.

A recovering member 102 for the broken and waste rice grains is provided on the upper side of the horizontal portion 99 via connecting members 101. The recovering member 102 has an annular horizontal portion 103, an annular vertical portion 104 and an annular inclined portion 105. The upper end of the inclined portion 105 is close to the lower end of the separating cylinder 85, and a lower unriped grain passage 106 is formed between the inclined portions 100, 105. An unriped grain discharge port 107 is formed in the space between the horizontal portions 99 and 103.

Figure 7:
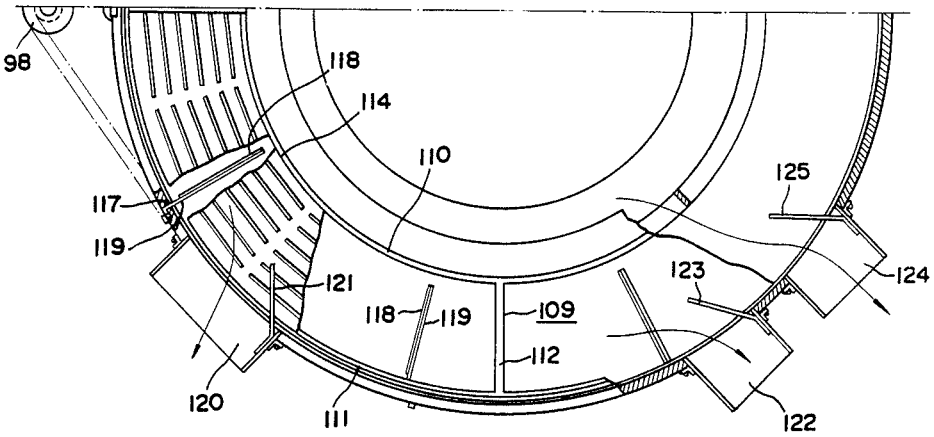
FIG. 7 is a partially cutaway view in plan of what is shown in FIG. 6.
Figure 8:
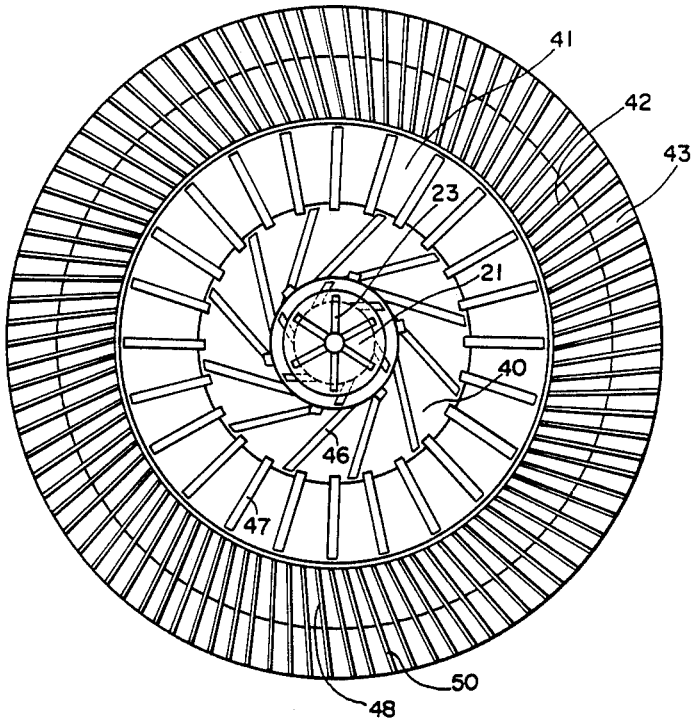
FIG. 8 is a plan view of the feed section.
Figure 9:
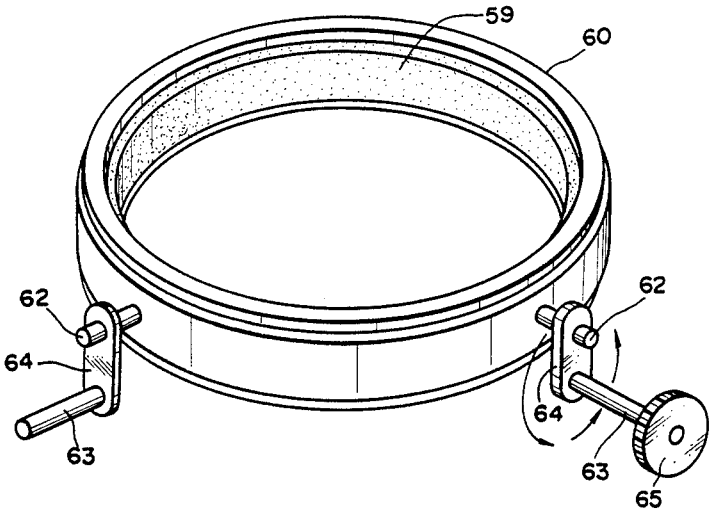
FIG. 9 is a perspective view of an elastic member.
Figure 10:
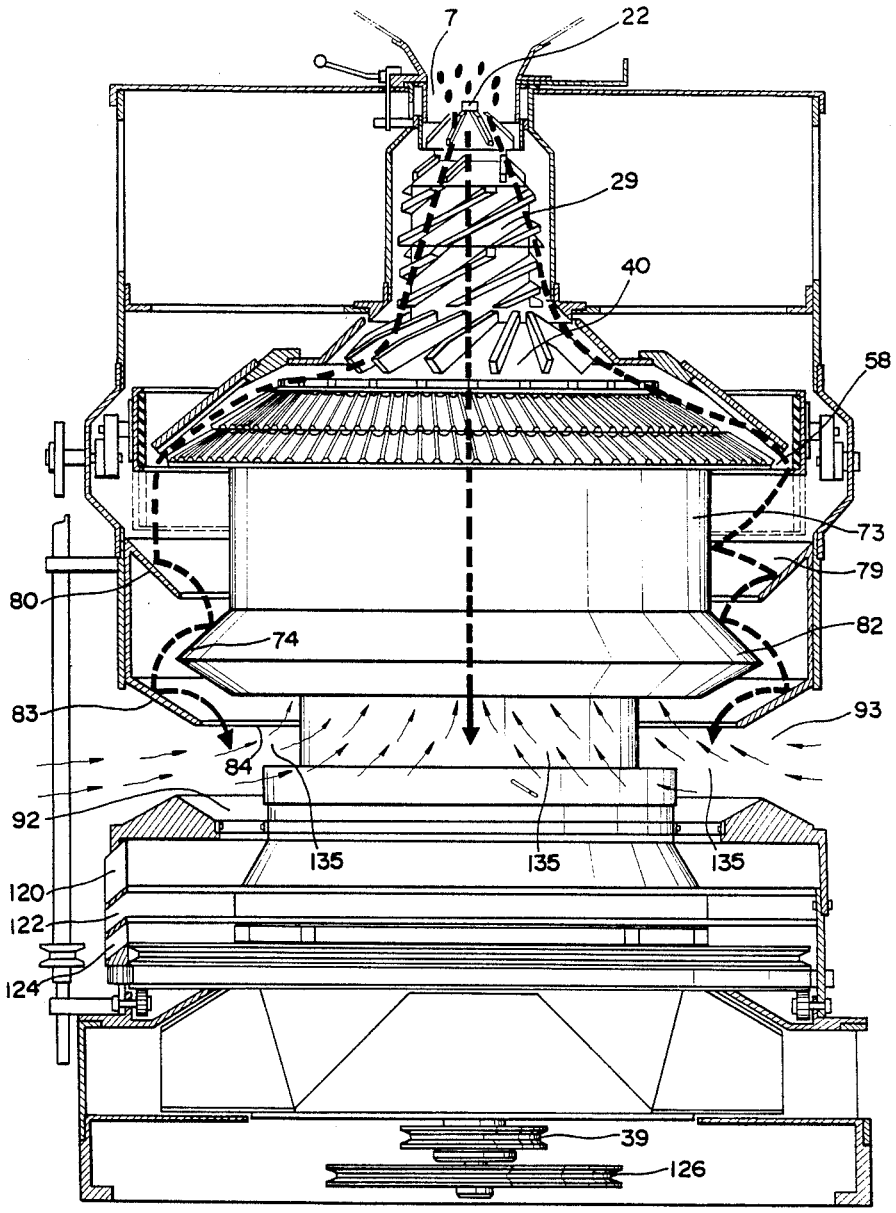
FIG. 10 illustrates the embodiment in operation.

A sorting plate-setting frame 109 is formed by combining inner and outer rings 110 and 111 with each other by connecting members 112 (FIG. 7), and the outer ring 111 forms L-shaped locking groove 113. The vertical portion 104 is provided in its upper end section with a locking recess 108. The sorting plate 96 is located above the frame 109. The sorting plate 96 is divided into four parts, and inserted at its inner end portion 114 into the locking recess 108, the outer end portion 115 of this plate 96 being engaged from the upper side with the locking groove 113.

The sorting plate 96 is adapted to be turned unitarily with the rotary member 97. The space between the sorting plate 96 and horizontal portion 103 forms a waste rice discharge chamber 116. Insert ports 117 are provided in a desired portions of the outer surface of the inner case 2 (FIG. 7), and rods 119 to which cleaning members 118 are attached, respectively, are inserted from and fixed to the insert ports 117. The cleaning members 118 are adapted to rub the under surface of the perforated sorting plate 96.

Reference numeral 120 denotes a hulled rice recovering port, 121 a hulled rice guide wall, 122 a waste rice recovering port, 123 a waste rice guide wall, 124 an unriped rice recovering port, 125 an unriped guide wall, 126 a pulley, 127 vertical shaft rollers, and 128 horizontal shaft rollers.

A windmill chamber 129 is provided under the annular downward air flow passage 95, and a windmill 130 in the windmill chamber 129. The windmill 130 is rigidly mounted on a shaft cylinder 131 which is fitted around the lower end portion of the double shaft 35. Reference numeral 132 denotes an air outlet port.

Operation

The operation of the present invention will now be described.

When the pulleys 39 and 126 are turned by a motor provided in a desired position, the second feed member 33 is rotated via the shaft cylinder 131 and double shaft 35 by the pulley 39, and the first and second distributors 21 and 27 and the first feed member 29 are rotated via the vertical rotary shaft 20 by the pulley 126.

During this time, the second feed member 33 and the feeder 67 are rotated at a higher speed than the distributors 21 and 27 and the first feed member 29, since the diameter of the pulley 126 is larger than that of the pulley 39.

Due to the rotation of the shaft cylinder 131, the windmill 130 is rotated to discharge air, which is drawn from the air inlet port 93, to the outside of the machine through the air separating chamber 135, the annular upward and downward air passages 94, 95, the windmill chamber 129 and the discharge port 132.

When the rotary shaft 66 is turned, the worm wheel 65 is rotated to cause the horizontal rotary shaft 63 to be rotated, so that the link 64 mounted on the rotary shaft 63 is turned therearound along a flat plane. Since the horizontal shaft 62 is moved along a surface of second order, the rotation portion of the link 64 and the horizontal shaft 62 are moved slidingly on each other. Consequently, the support member 60 and the elastic member 59 fitted in the locking recess 61 are vertically moved.

When the unhulled or paddy rice is then fed to the hopper 6 positioned at the upper side of the machine, it flows from the inside of the hopper-setting member 5 into the feed cylinder 7 and then onto the upper portion of the first distributor 21. The unhulled rice is then scattered by the distributing ribs 23 of the first distributor 21, and the scattered unhulled rice impinges upon the inner surface of the regulating cylinder 12, which is provided on the outer side of the first distributor 21, the unhulled rice being repelled thereby. The unhulled rice then advances downwardly and falls without colliding with one another from the regulating port 26 formed between the lower ends 24 and 25.

The second distributor 27 is provided under the falling port 26, and the second distributing ribs 28 are formed on the upper surface of the second distributor 27. Therefore, the unhulled rice is fed onto the second distributing ribs 28 and distributed again. Since the second distributor 27 is formed in a larger diameter than the first distributor 21, the unhulled rice falling from the falling port 26 is distributed at a higher speed. The outer feed cylinder 9 is positioned on the outer side of the second distributor 27. Accordingly, the unhulled rice distributed by the second distributing ribs 28 is radiated against and repelled by the inner surface of the outer feed cylinder 9.

The unhulled rice radiated by the second distributor 27 is reflected on the inner surface of the outer feed cylinder 9 and then subjected to the operation of the first feed ribs 31 on the first feed member 29. The rotational speed of the first member 29 is considerably high as mentioned above, and the first feed ribs 31 are formed at regular intervals and at an angle of inclination close to zero. Accordingly, the unhulled rice flown by the second distribution ribs 28 falls not rapidly but gradually.

Since the first feed ribs 31 are formed so as to have a height increasing gradually toward their lower ends 32, and a large diameter, the peripheral speed of the lower ends 32 becomes maximal. Therefore, the unhulled rice is substantially turned with the feed ribs 31 at their lower ends 32. The resultant rice continues to flow smoothly into the spaces among the second feed ribs 34 on the second feed member 33 which is rotated at a higher speed than the first feed member 29.

Since the rotational speed of the second feed ribs 34 on the second feed member 33 is higher than that of the first feed member 29, the grain flowing onto the second feed member 33 is accelerated gradually and sent downwardly. The grain then flows into the spaces among the first acceleration ribs 46 on the first acceleration member 40. The purpose of turning the grain at such a gradually-increasing speed is to enable the grain to be ejected in mutually-separated state from the annular ejection port 58, and prevent the grain from colliding with one another in the air.

The operation of the rice huller will further be described. The grain flowing into the spaces among the first acceleration ribs 46 is accelerated gradually and reflected on the repelling surface 53 of the cover 51 due to the centrifugal force. The grain then springs back to the spaces among the second acceleration ribs 47 on the second acceleration member 41, and are sent out by the centrifugal force. The grain thus is fed to the spaces among the third acceleration ribs 48 on the third acceleration member 42 which is provided under the second acceleration member 41. The grain is sent out due to the stepped portion 49 by the centrifugal force, and the grain flows into the array channels 133 on the inner surface of the array member 55, the grain being then repelled by the array member 55 and fed into the spaces among the fourth acceleration ribs 50 on the fourth acceleration member 43. The grain is sent out again by the centrifugal force, and flows again into the array channels 133. Since the grain is repelled in this manner a plurality of times, all the grain is finally discharged separately from the array channels 133. It is important that the grain be discharged finally from the array channels 133 on the under surface of the array member 55. To meet this requirement, this rice huller is made capable of discharging the grain separately.

The unhulled rice emerging from the ejection port 58 strikes the elastic member 59, which is fitted in the recess 61 formed in the inner surface of the annular support member 60, and it is thereby hulled. Since the grain is radiated separately until it strikes the inner surface of the elastic member 59, and the radiating of the grain is done in the downward direction, so that the grains do not collide with one another in the air.

The elastic member 59 is turned three-dimensionally in the vertical direction via the horizontal rotary shaft 63, link 64 and shaft 62 in accordance with the rotation of the worm wheels 65, so that the unhulled rice strikes upon every part of the whole surface of the elastic member 59. Therefore, the wear on a certain portion of the surface of the elastic member 59 can be prevented.

The struck grain falls onto the inclined members 80, 82 and 83 to flow therealong for reducing the falling speed thereof and fall the air separating chamber 135. In the separating chamber, light husks are drawn up into the air passage 94 by separating air to be withdrawn and discharged from the port 132. Unriped rice which is of medium weight falls into the annular gap 87 by separating air and enters the discharge port 107 via the passage 106, and are outwardly sent by the horizontal pivotal movement of the discharge port 107, the unriped rice being then recovered from the recovering port 124.

Figure 6:
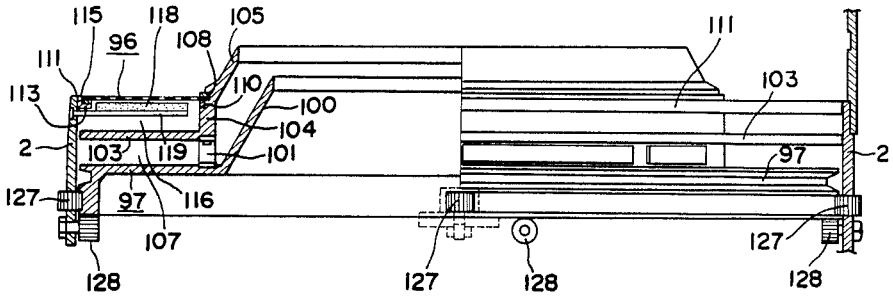
FIG. 6 is a sectional view of a recovery section.

The hulled rice and waste rice fall through the separating chamber 135 and drop port 92 onto the perforated sorting plate 96. Since the perforated sorting plate 96 is turned horizontally at a considerably speed around the rotary shaft 20, the broken and waste rices which are smaller than the perforates of the plate 96 are, separated and fall into the waste rice discharge chamber 116 provided below the sorting plate 96 (FIG. 6). The waste rice is sent outwardly due to the rotary movement of the discharge chamber 116, and recovered from the waste rice recovering port 122. The hulled rice left on the perforated sorting plate 96 is recovered from the hulled rice recovering port 120.

Effect

In the feeder 67 in the present invention, the paddy rice is gradually accelerated so as to be move along the array channels 133 on the under surface of the umbrella type array member 55 and discharged grain by grain from the circumferential ejection port 58 in the diagonally downward direction. Accordingly, the grain does not collide with one another in the air until the grain impinges upon the inner surface of the belt type elastic member 59. This enables 100% of paddy rice to be hulled.

Since a 100% rice hulling operation can be carried out, the separation of unhulled rice from the processed grain, which is required to be done in prior machines, becomes unnecessary.

An aerial sorting chamber and a waste rice separator can be formed under the feeder 67, so that the rice huller as a whole can be minimized.

What is claimed is:

1. A vertical type impact huller for processing grains so as to remove husks therefrom, comprising:

a vertical rotary shaft;

an umbrella type feeder rigidly mounted on an upper portion of the shaft and adapted to turn with the shaft, said feeder having an upper cover and a bottom plate approximately parallel to the upper cover, the upper cover having an undersurface and array channels on an outer portion of the undersurface, the grains being discharged in an oblique downward direction from the array channels in a non-mutually contacting state, and said feeder further having an annular ejection port formed between outer ends of the upper cover and the bottom plate through which the grains are ejected;

an annular elastic member surrounding the ejection port in a peripherally spaced relationship therewith wherein the grains ejected from the ejection port strike a surface of the elastic member; and an air separating chamber provided below the feeder for separating husks from processed grains and separating means for separating broken and/or waste grains disposed below the air separating chamber and around the rotary shaft.

2. An apparatus as claimed in claim 1, wherein said elastic member is adapted to be moved in a vertical direction as it turns in right and left directions for allowing substantially uniform wear of the elastic member.

3. An apparatus as claimed in claim 1, further comprising means for reducing a falling speed of the processed grains provided between the ejection port and the air separating chamber, an annular upward air passage and an annular downward air flow passage for directing air flow and a windmill disposed below the annular downward air flow passage to discharge air to outside of the apparatus.

4. An apparatus as claimed in claim 1, wherein the feeder comprises at least two groups of ribs provided on the bottom plate, a first group of ribs having an angle of sweepback, and a second group of ribs having an angle of advance.

5. An apparatus as claimed in claim 1, wherein said elastic member is elastically and detachably mounted within an annular recess formed at an inner surface of an annular support member which is vertically movably mounted on a framework assembly of the apparatus.

* * * * *